US008680746B2

(12) United States Patent
Takahashi et al.

(10) Patent No.: US 8,680,746 B2
(45) Date of Patent: Mar. 25, 2014

(54) PIEZOELECTRIC ACTUATOR AND ELECTRONIC DEVICE

(75) Inventors: Masatake Takahashi, Tokyo (JP); Yasuhiro Sasaki, Tokyo (JP); Yasuharu Onishi, Tokyo (JP)

(73) Assignee: NEC Corporation, Tokyo (JP)

( * ) Notice: Subject to any disclaimer, the term of this patent is extended or adjusted under 35 U.S.C. 154(b) by 359 days.

(21) Appl. No.: 12/601,485

(22) PCT Filed: May 21, 2008

(86) PCT No.: PCT/JP2008/059346

§ 371 (c)(1),
(2), (4) Date: Nov. 23, 2009

(87) PCT Pub. No.: WO2008/146678

PCT Pub. Date: Dec. 4, 2008

(65) Prior Publication Data

US 2010/0165794 A1 Jul. 1, 2010

(30) Foreign Application Priority Data

May 23, 2007 (JP) ..... 2007-136987

(51) Int. Cl.
*B06B 1/06* (2006.01)

(52) U.S. Cl.
CPC ..... *B06B 1/0603* (2013.01)
USPC ..... 310/323.02; 310/324

(58) Field of Classification Search
USPC ..... 310/323.01–323.21, 324, 328, 329
See application file for complete search history.

(56) References Cited

U.S. PATENT DOCUMENTS

| | | | | |
|---|---|---|---|---|
| 7,635,941 | B2 * | 12/2009 | Bank et al. | 310/328 |
| 2001/0026625 | A1 * | 10/2001 | Azima et al. | 381/152 |
| 2002/0175596 | A1 * | 11/2002 | Garimella et al. | 310/328 |
| 2002/0175597 | A1 * | 11/2002 | Raman et al. | 310/328 |

FOREIGN PATENT DOCUMENTS

| | | | |
|---|---|---|---|
| JP | 62-225279 | A | 10/1987 |
| JP | 10-506033 | A | 6/1996 |
| JP | 11-19591 | A | 1/1999 |
| JP | 11-65569 | A | 3/1999 |
| JP | 2000135472 | A | 5/2000 |
| JP | 3085481 | B | 2/2002 |

OTHER PUBLICATIONS

Machine translation of JP 11-065569, provided by the website of the Japanese Patent Office, published Mar. 1999.*

* cited by examiner

*Primary Examiner* — Derek Rosenau
(74) *Attorney, Agent, or Firm* — Sughrue Mion, PLLC

(57) ABSTRACT

Provided is a small-size thin piezoelectric actuator which can be mounted on a mobile electronic device and operate with a low power consumption also provided is an electronic device which uses the piezoelectric actuator to provide a function to give a contact feeling of a three dimensional movement to a users hand palm. The piezoelectric actuator (1) includes: a piezoelectric ceramic oscillator having a piezoelectric ceramic thin plate (5) bonded to at least one surface of a shim member (6); at least one holder (7) for holding the shim member (6); and a sheet-shaped elastic body (2). Vibration generated by the piezoelectric ceramic oscillator is transmitted via the holder (7) and the sheet-shaped elastic body (2) to a case (3) of the electronic device.

13 Claims, 12 Drawing Sheets

GRID

SIDE

X SHAPE

CIRCULAR

PIEZOELECTRIC ACTUATOR AND ELECTRONIC DEVICE

TECHNICAL FIELD

Reference to Related Application

This application is the National Phase of PCT/JP2008/059346, filed May 21, 2008, which is based upon and claims the benefit of the priority of Japanese patent application No. 2007-136987, filed on May 23, 2007, the disclosure of which is incorporated herein in its entirety by reference thereto.

This invention relates to a piezoelectric actuator and a mobile electronic device having the piezoelectric actuator.

BACKGROUND ART

Recently small portable devices such as a mobile phone, note-type personal computer and personal digital assistant (PDA) are frequently utilized. Applications of these devices are spreading and conveniences of users' are increasing with a development of network systems and software. Then requirements are increasing for high-performance devices to communicate information precisely using vibration or sonic wave, and quality improvements are expected for vibration components such as a oscillator, vibration sensor or touch sensor and audio equipments such as a speaker, microphone or receiver. As for vibrators, characteristics such as a small size, light weight and low power consumption are being developed and a range of its use is increasing.

To downsize and save power consumption of the vibrators, driving sources to replace conventional electromagnetic actuators are now being developed. An electromagnetic actuator consisting of a permanent magnet and a voice coil is not suitable to mount on a mobile electronic device such as a mobile phone because it does not save electric power since the voice coil needs much current when actuating and it is difficult to downsize the actuator due to structural problems. Thus efforts are made for development of a vibrator using a piezoelectric actuator as a driving source having a feature of a small size, light weight and low power consumption.

On the other hand, a vibrator is expected to stimulate ones skin or hand palm by a mechanical vibration and use for a communication tool of information with a stereoscopic effect and affinity by contact feeling of the vibration produced simultaneously with a telephone call as well as for a notice of the call.

In a mobile electronic device (designated as "mobile device" hereinafter) such as a conventional mobile phone, personal digital assistant or game equipment, a means of information transmission to a user is utilized such as a visual method by a display, auditory method by a speaker, etc, or contact feeling method by a vibrator (actuator). Particularly, an information transmission method is developed which utilize the contact feeling with interaction of visual sense or auditory sense. For example, a method to produce a vibration by an actuator in connection with a display is known for its effect of enhancing affinity and stereoscopic effect by a combination of the contact feeling and visual sense. On the other hand, a game machine is put to practical use that provides high ambience by producing vibration together with movements of subjects such as persons, animals or vehicles on a display.

Patent Document 1 discloses a contact feeling generator to convey the contact feeling to a player in connection with movements on a display of a video game, etc. Patent Document 2 discloses an example of an electronic device using a piezoelectric actuator as a vibration component, in which a plurality of piezoelectric actuators are provided on the case of the electronic device and information is transmitted to a user by the vibration of a case produced by the actuator. Patent Document 3 discloses a vibration-type information device to notify a call to a user by auditory sense and contact feeling produced by a piezoelectric ceramic oscillator provided in a pager, etc.

Patent Document 1:

JP Patent Kohyo Publication No. JP-H10-506033A

Patent Document 2:

JP Registered Utility Model No. 3085481

Patent Document 3:

JP Patent Kokai Publication No. JP-H11-65569A

DISCLOSURE OF THE INVENTION

Problems to be Solved by the Invention

The entire disclosures of Patent Documents 1 to 3 are incorporated herein by reference thereto. The following analyses are given by the present invention.

The contact feeling generator disclosed in Patent Document 1 consists of a plurality of actuators arranged in a line on a flexible pad and a three-dimensional contact feeling including up and down directions is not obtained. Also, Patent Document 1 does not mention any techniques related to noise reduction, downsizing, slim sizing or low consumption using batteries. In addition, vibration transmission blocks are protruding from the flexible pad; however, a mobile electronic device having a number of protrusions on a case surface may feel uncomfortable to users holding the device, and further, may detract from design qualities.

Patent Document 2 discloses a technique using an effect of localized vibration using differences of strengths of vibrations on a case or a touch pad by separately activating a plurality of piezoelectric actuators provided in the case or the touch pad of the electronic device. In such a structure providing and activating a plurality of actuators in a small case of such a mobile device, a crosstalk, that is, propagation of vibration generated from one actuator to parts other than a desired part, may occur. However, Patent Document 2 discloses no description referring to a structure to prevent the vibration crosstalk.

Patent Document 3 has a purpose to produce strong vibration on a case by providing a piezoelectric ceramic element held by a shim member in the case. However, there is no description about a noise of an actuator when activated and stability against falling impact which are problems to be solved when the technique is used for electronic devices . Particularly, the stability against falling impact should be considered when the actuator is mounted on a mobile electronic device because fragile ceramic material is used.

The present invention has been done by taking above problems into consideration. An object is to provide a piezoelectric actuator which can transmit vibration mutually and effectively. Another object is to provide an electronic device having a feature to convey a contact feeling of a three-dimensional movement to a user by transmitting the vibration to a hand palm of the user.

Means to Solve the Problems

According to a first aspect of the present invention, there is provided a piezoelectric actuator having a shim member, at least one piezoelectric ceramic oscillator formed of a piezoelectric ceramic thin plate bonded to at least one surface of the shim member and at least one holder which holds the shim member, and the actuator comprises a sheet-shaped elastic body which is connected to the holder, and vibration of the piezoelectric ceramic oscillator is transmitted to a case of an electronic device via the holder and the sheet-shaped elastic body.

According to a second aspect of the present invention, preferably the actuator further comprises at least one auxiliary holder connected between the piezoelectric ceramic oscillator and the sheet-shaped elastic body at a position apart from the holder, and the vibration of the piezoelectric ceramic oscillator is transmitted to the case via the holder, the auxiliary holder and the sheet-shaped elastic body.

According to a third aspect of the present invention, preferably the actuator further comprises at least one auxiliary holder connected between the shim member and the sheet-shaped elastic body at a position apart from the holder, and the vibration of the piezoelectric ceramic oscillator is transmitted to the case via the holder, the auxiliary holder and the sheet-shaped elastic body.

According to a fourth aspect of the present invention, preferably a narrow part is formed in the shim member at between adjoining piezoelectric ceramic oscillators bonded on the shim member.

According to a fifth aspect of the present invention, preferably a plurality of the piezoelectric ceramic oscillators are connected to the sheet-shaped elastic body via the holder and the auxiliary holder, and a groove is formed on the sheet-shaped elastic body at between adjoining piezoelectric ceramic oscillators.

According to a sixth aspect of the present invention, preferably a plurality of the piezoelectric ceramic oscillators are connected to the case via the holder, the auxiliary holder and the sheet-shaped elastic body, and outer surface portions of the case connected to the piezoelectric ceramic oscillators are partitioned each other by a groove.

According to a seventh aspect of the present invention, preferably the piezoelectric ceramic oscillator and the case are connected by a metal hinge having at least one bending portion via the sheet-shaped elastic body. The bending portion contributes to the transmission of the vibration. Particularly U-shaped bending portion is effective.

According to an eighth aspect of the present invention, preferably a penetration hole is perforated at a part of the case where the piezoelectric ceramic oscillator is connected, and the penetration hole is filled with an elastic body.

According to a ninth aspect of the present invention, preferably the piezoelectric ceramic oscillator is activated by a pulse shaped or sinusoidal alternating electric field having a frequency of 100 Hz to 1 kHz.

According to a tenth aspect of the present invention, there is provided an electronic device mounting the piezoelectric actuators mentioned above aspects as a plurality of oscillation sources and the electronic device has a function to convey various kinds of information to a user by making a case of the electronic device vibrate in multiple stereoscopic patterns.

According to a eleventh aspect of the present invention, there is provided an electronic device mounting the piezoelectric actuators mentioned above aspects as a plurality of oscillation sources to vibrate a case of the electronic device stereoscopically.

According to a twelfth aspect of the present invention, the case of the electronic device has a groove or a part of different thickness.

According to a thirteenth aspect of the present invention, there is provided an electronic device mounting the piezoelectric actuator mentioned above aspect and having a function to convert vibration generated on a case into voltage by the piezoelectric actuator.

Effect of the Invention

The piezoelectric actuator according to the present invention uses a piezoelectric ceramics which is known to have a high rigidity as an oscillation source, and therefore, it makes possible to vibrate a case of a mobile electronic device having a high rigidity and realizes to convey information to a user by vibration of the case. Since the vibration of each piezoelectric ceramic oscillator can be separated effectively, stereoscopic vibrations can be transmitted effectively by vibrating multiple piezoelectric actuators in different frequencies and/or strengths. On the contrary, it becomes possible to utilize as a touch panel or a vibration sensor by transmitting the vibration of the case to the piezoelectric ceramic oscillator and converting to voltage.

EXPLANATIONS OF SYMBOLS

Figure 1A:
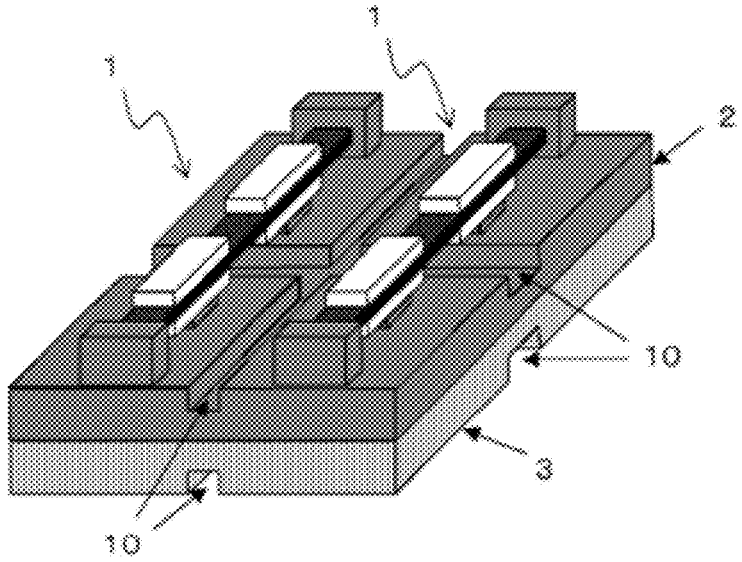
FIG. 1A is a perspective view in which two piezoelectric actuators according to an embodiment 1 of the present invention are arranged and FIG. 1B is a perspective view of a constitution of the piezoelectric actuator according to an exemplary embodiment 1 of the present invention.

1 piezoelectric actuator
2 sheet-shaped elastic body

2*a* elastic body on a surface of a case
2*b* elastic body in a penetration hole
3 case
4 electronic component
5 piezoelectric ceramic thin plate
6 shim member
7 holder
8 auxiliary holder
9 narrow part (cut out)
10 groove
11 metal hinge
12 vibration magnification structure

PREFERRED MODES FOR CARRYING OUT THE INVENTION

Exemplary embodiments of the present invention will be explained with reference to drawings. In the following explanation of a structure of each exemplary embodiment, the same structural parts are designated by the same symbols and a repetition of the explanation is omitted.

(Exemplary Embodiment 1)

Figure 1B:
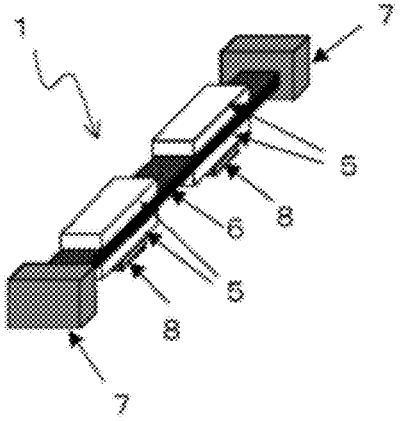

FIG. 1B is a perspective view of a piezoelectric actuator 1 according to an exemplary embodiment 1 of the present invention. The piezoelectric actuator 1 according to an exemplary embodiment 1 comprises two piezoelectric ceramic oscillators each of which consists of two piezoelectric ceramic thin plates 5 bonded on both sides of a shim member 6, two holders 7 which hold the shim member 6 at both ends of the shim member and auxiliary holders 8 arranged between the piezoelectric ceramic oscillators and a sheet-shaped elastic body. FIG. 1A is a perspective view in which two piezoelectric actuators 1 constituted as explained above are arranged on a case 3 of an electronic device via the sheet-shaped elastic body 2.

Figure 2:
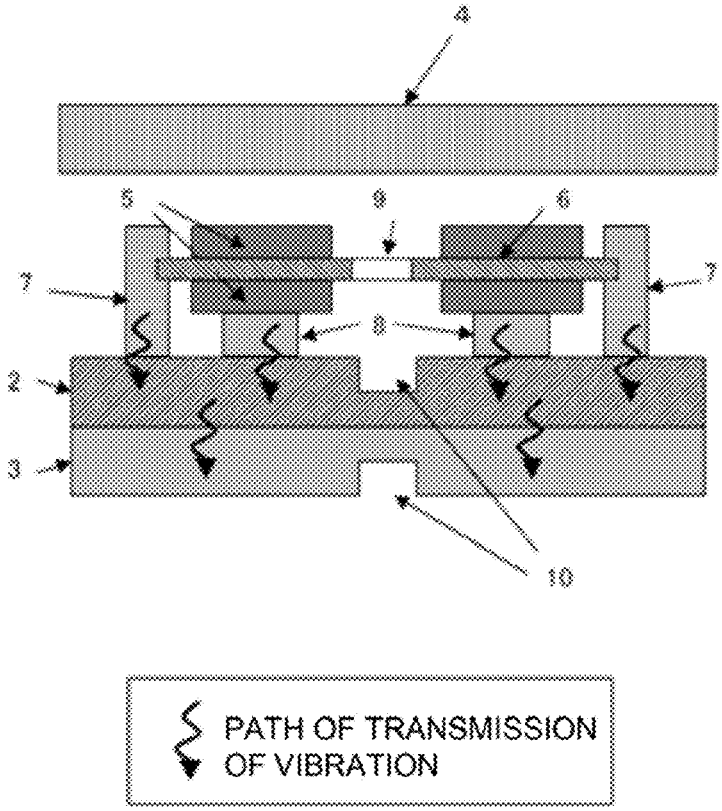
FIG. 2 is a sectional view of the piezoelectric actuator according to the exemplary embodiment 1 attached on a case of an electronic device.

FIG. 2 is a sectional view of the piezoelectric actuator 1 shown in FIG. 1B attached on the case 3 of an electronic device via the sheet-shaped elastic body 2.

In FIG. 2, the piezoelectric ceramic oscillator has a bimorph structure in which two piezoelectric ceramic thin plates 5 are bonded on both sides of the plate-shaped shim member 6. In addition, two independently operable piezoelectric ceramic oscillators are arranged apart from each other on the common shim member 6. This means that two piezoelectric ceramic oscillators are constituted by bonding two sets of two piezoelectric ceramic thin plates 5 on both sides of the shim member 6 at positions except both end portions and center portion. A groove is provided on the holder 7 and the shim member 6 is fixed by being inserted in the groove. The piezoelectric ceramic oscillator may be a unimorph structure in which a piezoelectric ceramic thin plate 5 is bonded on one side of the shim member 6.

Piezoelectric ceramics of a non-lead system such as a piezoelectric ceramics of the PZT system or barium titanic oxide may be used for the piezoelectric ceramic thin plate 5, and the ceramics of the PZT system is preferable from the viewpoint of its piezoelectric characteristics. And a ceramics mono-plate of a size of approximately 0.03 to 0.2 mm is preferable from the viewpoint of a resonance frequency of the piezoelectric ceramic oscillator and a total size and component cost of the actuator. However, it is not limited to these examples and a laminate-type piezoelectric ceramics, for example, may be used.

The auxiliary holder 8 is formed in a size so as to contact with both of the sheet-shaped elastic body 2 and the piezoelectric ceramic oscillator and the thickness is determined by shapes and sizes of the piezoelectric ceramic thin plate 5, shim member 6 and holder 7. The auxiliary holder 8 is fixed to both of the piezoelectric ceramic oscillator and the sheet-shaped elastic body 2 and an epoxy-type adherent may be used for the fixation, for example. The auxiliary holder 8 increases a transmission path of vibration to the sheet-shaped elastic body 2 and contributes effective transmission of the vibration.

A material for the auxiliary holder 8 is not particularly limited and elastic organic material such as an ABS, silicone rubber, PET or poly-carbonate resin may be selected.

The auxiliary holder 8 is arranged apart from the holder 7. When the auxiliary holder 8 is arranged just beside the holder 7, the piezoelectric ceramic oscillator does not bend enough at a portion near the end and vibration capacity becomes small. When some distance is kept as this exemplary embodiment, the piezoelectric ceramic oscillator will bend enough at the distance and the vibration capacity becomes enough. However, the distance between the auxiliary holder 8 and the holder 7 is not particularly limited.

The shim member 6 is fixed by the holder 7 at both ends and the two sets of two piezoelectric ceramic thin plates 5 are bonded on both sides remaining center portion of the shim member. It is preferable to provide a narrow part (cut out) 9 (not shown in FIG. 1) at the center portion of the shim member. Such a narrowed structure causes a drastic change of mechanical impedance at the narrow part 9. Therefore, when two piezoelectric ceramic oscillators are activated independently, vibration of one piezoelectric ceramic oscillator does not transmitted so much to the other piezoelectric ceramic oscillator and it makes possible to prevent transmission of undesired vibration.

A material for the shim member 6 is not particularly limited but may be selected from metal materials having high rigidity such as a phosphor bronze, 42 alloy and SUS. A resin film having a metal film on the surface, etc. may be used to adjust a resonance frequency when the piezoelectric ceramic thin plate 5 is thick.

Figure 6A:
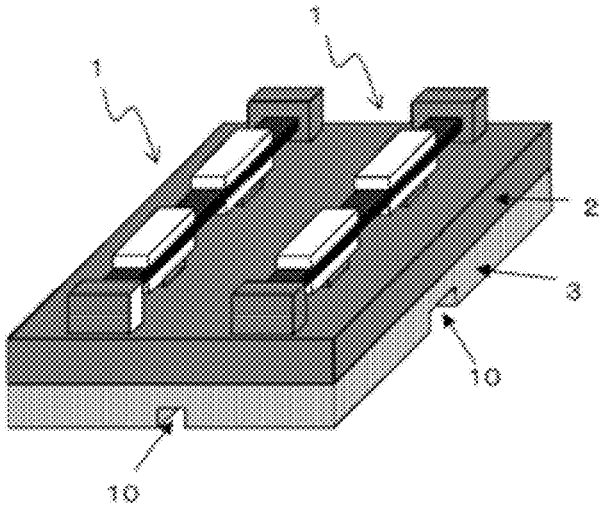
FIG. 6A is a perspective view of a piezoelectric actuator according to Example 1 of the present invention and FIG. 6B shows observation points of Example 1.
Figure 6B:
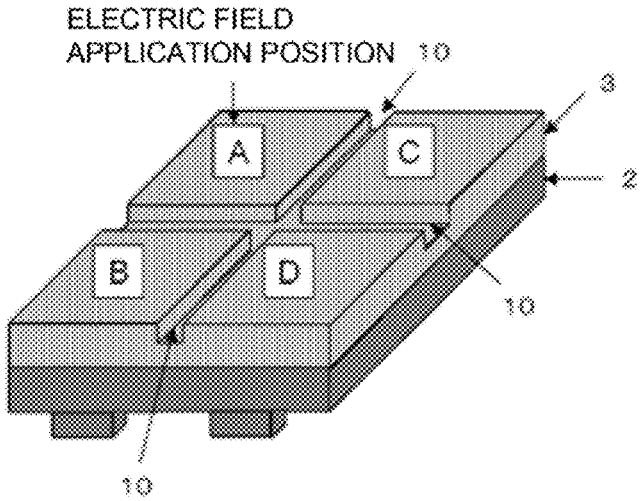

Preferably a case 3 connected to the piezoelectric actuator 1 according to an exemplary embodiment 1 has a structure on which a groove (or a part of different thickness) 10 is formed so as to mark off separate surface areas of the case corresponding to positions mounting the piezoelectric ceramic oscillators as shown in FIG. 6B. By forming the groove 10 so as to mark off the piezoelectric ceramic oscillators, it becomes possible to reduce transmission of unnecessary vibration to other areas, and an area surrounded by the groove 10 of the surface of the case 3 connected to the piezoelectric ceramic oscillator via the sheet-shaped elastic body 2 can be mainly vibrated. Although a width and a depth of the groove 10 are not particularly limited, it may be preferable to have a width of 0.1 to 2 mm and a depth of 10 to 90% of the thickness of the case 3.

In FIG. 1A two piezoelectric actuators 1 are connected to the case 3 via the sheet-shaped elastic body 2; however, it is not limited to two but more than two piezoelectric actuators 1 may be arranged at positions on the case 3, preferably at positions corresponding to user's hand palm or fingers.

As shown in FIG. 1A, the sheet-shaped elastic body 2 connected to the piezoelectric ceramic oscillators preferably has a structure having a groove 10 between the positions where the piezoelectric ceramic oscillators are mounted. That prevents the vibration produced by the piezoelectric ceramic oscillator from being transmitted to other piezoelectric ceramic oscillators or electronic components as undesirable vibration. A width and a depth of the groove 10 formed on the sheet-shaped elastic body 2 are not particularly limited but it is preferable to have a width of 0.1 to 2 mm and a depth of 10 to 90% of the thickness of the sheet-shaped elastic body 2. A material of the sheet-shaped elastic body 2 is not particularly limited but an organic material such as a silicone rubber or butyl rubber may be selected.

Although the piezoelectric actuator 1 is connected to the case 3 via the sheet-shaped elastic body 2, it is arranged so as not to contact with other electronic components such as a circuit board or a LSI. The reason is that when the vibration produced by the piezoelectric actuator 1 is directly transmitted to the electronic components, it causes a malfunction or an unusual sound or noise. The piezoelectric actuator 1 may be connected to the case 3 using adherent, for example.

Figure 12A:
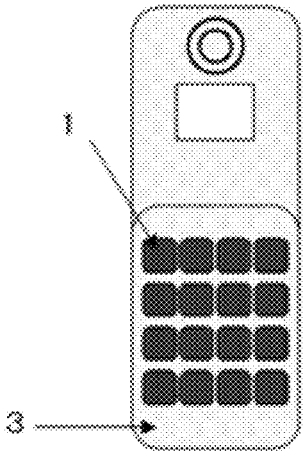
FIG. 12 illustrates examples of electronic devices arranging the piezoelectric actuators.
Figure 12B:
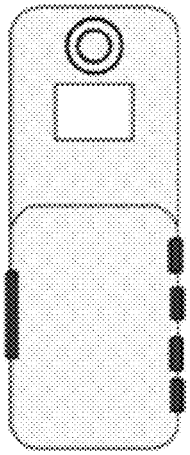
Figure 12C:
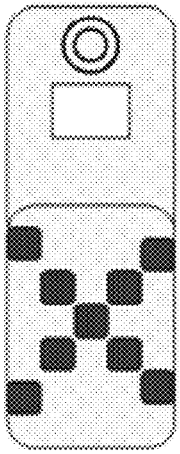
Figure 12D:
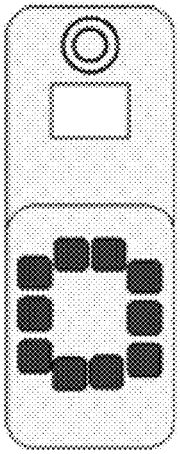

Next, an operation of the piezoelectric actuator 1 according to an exemplary embodiment 1 structured as explained above will be explained with reference to FIG. 2. According to the structure of the exemplary embodiment 1, the vibration of the piezoelectric ceramic oscillator is transmitted to the sheet-shaped elastic body 2 via the holder 7 and the auxiliary holder 8 and then to the case 3 (the transmission of the vibration is indicated by arrows). The piezoelectric actuator 1 may be structured without the auxiliary holder 8; however, it is preferable to use the auxiliary holder 8 because the vibration transmission path is added and vibration transmission efficiency is increased by forming two vibration points of the holder 7 and the auxiliary holder 8. The piezoelectric actuators 1 are preferably arranged at the positions where user's hand palm or fingers may contact when the user took the electronic device (mobile phone). Preferable arrangements are shown in FIGS. 12A and 12B but not limited to these arrangements.

As explained above, the piezoelectric actuator 1 of the exemplary embodiment 1 has two piezoelectric ceramic oscillators on one shim member 6. The reason is that it makes possible to produce vibrations that cannot be produced by only one piezoelectric ceramic oscillator. A three dimensional expressive power, which is a problem to be solved, may be improved by combining vibrations of the two piezoelectric ceramic oscillators in reversed phases or any shifted phases as well as oscillations in the same phase. In addition, when two or more piezoelectric ceramic oscillators are applied to an electronic device, more stereoscopic three dimensional vibrations are realized to transmit various kinds of information to a user of the electronic device by multiple combinations of activation voltages, activation waveforms, phases and frequencies of the piezoelectric ceramic oscillators.

An activation power source of the piezoelectric ceramic oscillator is not particularly limited and an alternating electromagnetic field of pulse wave or sinusoidal wave having a frequency of 100 to 1K Hz and an effective voltage of 10V may be used, for example.

Many kinds of variations are possible other than the exemplary embodiment 1. Some exemplary embodiments will be explained by way of example. As a matter of course, various kinds of structures, such as a structure of the piezoelectric ceramic oscillator, presence or absence of the groove of the case or the sheet-shaped elastic body as shown in exemplary embodiments, may be combined appropriately.

(Exemplary Embodiment 2)

Figure 3A:
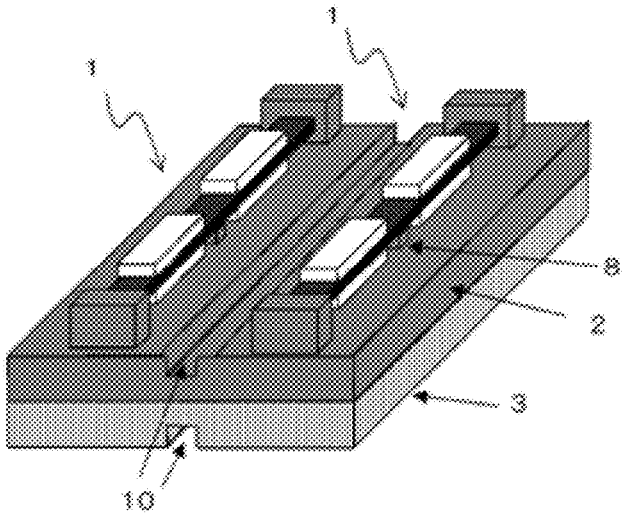
FIG. 3A is a perspective view in which two piezoelectric actuators according to an exemplary embodiment 2 of the present invention are arranged and FIG. 3B is a perspective view of FIG. 3A from a case side.
Figure 3B:
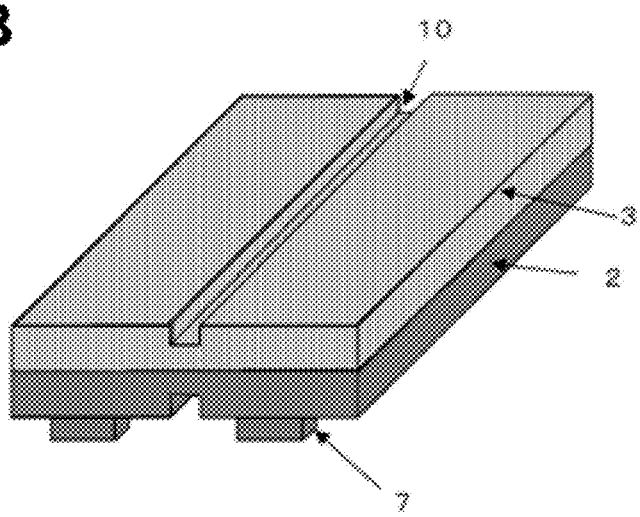

The auxiliary holder 8 may be arranged as shown in FIG. 3A. FIG. 3A is a perspective view in which two piezoelectric actuators 1 according to an exemplary embodiment 2 of the present invention are arranged. The auxiliary holder 8 of an exemplary embodiment 2 is not positioned between the piezoelectric ceramic thin plates 5 and the sheet-shaped elastic body 2 but around the center of the shim member 6 where the piezoelectric ceramic thin plate 5 is not bonded. This structure contributes to transmit the vibration of the two piezoelectric ceramic oscillators effectively to the sheet-shaped elastic body 2 via the center portion of the shim member 6 as an exciting point. The grooves 10 of the sheet-shaped elastic body 2 and the case 3 are provided, differently from FIG. 1A, only between the auxiliary holders 8 since one auxiliary holder 8 is used per two piezoelectric ceramic oscillators. FIG. 3B is a perspective view of FIG. 3A from a case side.

Although stereoscopic expressions by the vibrations are difficult by only one piezoelectric actuator according to an exemplary embodiment 2, combination of the two or more piezoelectric actuators can obtain the same effect as that of the exemplary embodiment 1.

(Exemplary Embodiment 3)

Figure 4A:
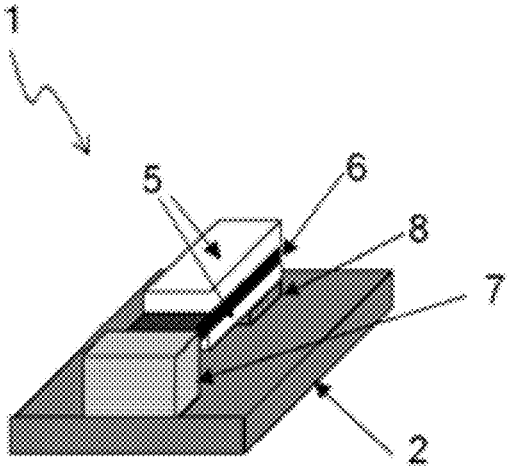
FIG. 4A is a perspective view of a piezoelectric actuator according to an exemplary embodiment 3 of the present invention and FIG. 4B is a sectional view of the piezoelectric actuator according to the exemplary embodiment 3 of the present invention.
Figure 4B:
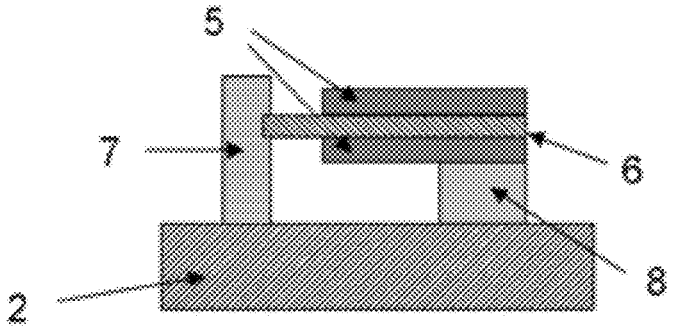

FIG. 4A is a perspective view of a piezoelectric actuator 1 according to an exemplary embodiment 3 of the present invention. FIG. 4B is a cross section thereof. As shown in FIG. 4B, two piezoelectric ceramic thin plates 5 are bonded to a shim member 6 except one edge portion and the edge portion of the shim member 6 is supported by a holder 7 to configure a cantilever-type piezoelectric ceramic oscillator. In this case, it is preferable to provide an auxiliary holder 8 on the piezoelectric ceramic oscillator to improve oscillation capacity. The position of the auxiliary holder 8 may be at an edge portion or center portion of the piezoelectric ceramic oscillator. The piezoelectric actuator according to the exemplary embodiment 3 can make it possible to reduce a mounting area of one piezoelectric actuator with keeping an amount of vibration of one piezoelectric ceramic oscillator of the exemplary embodiment 1. Similarly to exemplary embodiment 2, complicated stereoscopic expressions are possible to combine vibrations of two or more piezoelectric actuators.

(Exemplary Embodiment 4)

Figure 5:
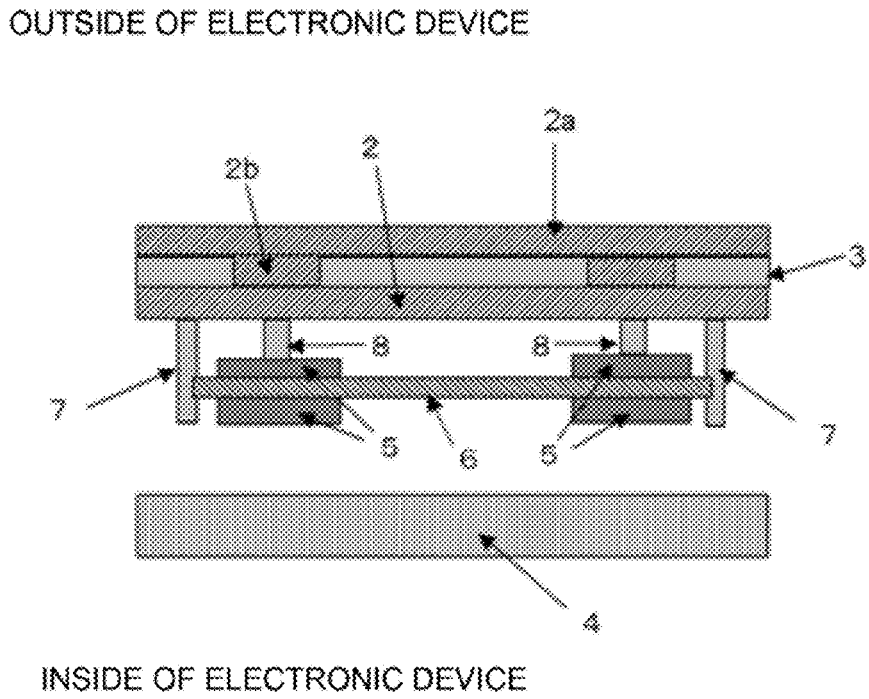
FIG. 5 is a sectional view of an electronic device according to an exemplary embodiment 4 of the present invention.

FIG. 5 is a sectional view of an electronic, device according to an exemplary embodiment 4 of the present invention. As shown in FIG. 5, a case 3 of the electronic device has penetration holes over the piezoelectric ceramic oscillators and an elastic body 2*b* is filled in the penetration holes. In addition, a surface of the case 3 is covered with an elastic body 2*a*. Such a structure can convey the vibration produced by the piezoelectric ceramic oscillators more directly to the user. A dropping shock resistance and humidity resistance are not deteriorated compared with exemplary embodiment 1 by wrapping all or a part of the case with the elastic body.

(Exemplary Embodiment 5)

Figure 11A:
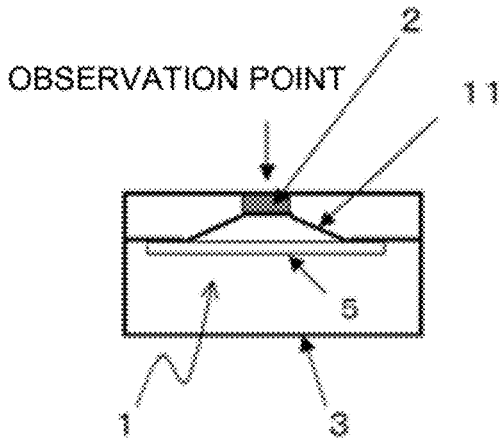
FIG. 11A is a sectional view of a piezoelectric actuator according to an exemplary embodiment 5 and Example 6 of the present invention and FIG. 11B is a sectional view of a piezoelectric actuator having a vibration magnification structure according to the exemplary embodiment 5 and Example 6 of the present invention.
Figure 11B:
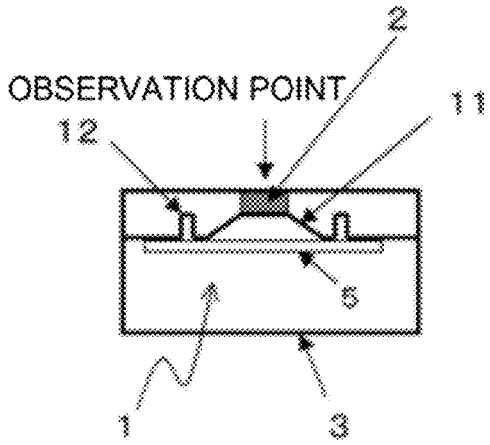

FIG. 11 is a sectional view of a piezoelectric actuator 1 and a case 3 according to an exemplary embodiment 5 of the present invention. As shown in FIG. 11A, bent metal hinge 11 is adhered to one side of a piezoelectric ceramic thin plate 5 and it is connected to the case 3 via a sheet-shaped elastic body 2. A vibration is amplified and transmitted effectively due to the bending of the metal hinge 11. The metal hinge 11 may be added besides a shim member 6 or the metal hinge may serve as a shim member 6. It may reduce a number of components and is suitable to arrange in a case of an electronic device which is required to be small and thin. As shown in FIG. 11B, a vibration magnification structure 12 of a U shaped portion in the metal hinge 11 may contribute to transmit more amount of vibration. A holder to support the shim member is not shown in FIG. 11.

(Exemplary Embodiment 6)

Exemplary Embodiments above explained are oriented to generate vibrations by applying electric voltage to piezoelectric ceramic oscillators having a function to convert electric power to mechanical movement. On the contrary, vibrations from a hand palm or fingers may be converted into electric voltage. A load applied to the case 3 is transmitted to the piezoelectric ceramic oscillators via the sheet-shaped elastic body 2 and the auxiliary holder 8 and converted into electric signals. The function may be utilized for a touch panel.

In addition, the function may be used for a vibration sensor in an electronic device.

EXAMPLES

Example 1

A piezoelectric actuator 1 illustrated in FIG. 1B was fabricated as Example 1. Piezoelectric ceramic plates, each of which is 10 mm in length, 4 mm in width and 0.2 mm in thickness, were prepared as piezoelectric ceramic thin plates 5 and Ag electrodes were formed on both main surfaces and polarized. Phosphor bronze plate, which is 32 mm in length, 4 mm in width and 0.2 mm in thickness and having a narrow part of 2 mm width at the center portion of 10 mm length, was used as a shim member 6 (the narrow part is not shown in FIG. 1B). A piezoelectric ceramic oscillator was fabricated by bonding the four piezoelectric ceramic thin plates 5 described above on both main surfaces of the shim member 6 at both end portions approximately 2 mm apart from each edge of the shim member and forming electrical wiring.

As for a holder 7, an ABS resin member, which is 4 mm in width, 4 mm in length and 2 mm in thickness, was prepared and a groove of 0.2 mm in depth to insert the shim member 6 was formed at a height of 1 mm. The shim member 6 and the holders 7 were fixed with an epoxy-resin.

Two silicone rubbers, each of which was 4 mm in width, 4 mm in length and 1.7 mm in height, were prepared as auxiliary holders 8. The auxiliary holders 8 were bonded to the piezoelectric ceramic oscillator with an epoxy-resin.

As shown in FIG. 6A, a silicone rubber of 42 mm in length, 16 mm in width and 0.5 mm in thickness without a groove was used for a sheet-shaped elastic body 2. Two piezoelectric actuators 1, each being formed of the piezoelectric ceramic oscillator, holders 7 and auxiliary holders 8, were bonded on the sheet-shaped elastic body 2 spaced by 4 mm using an epoxy-resin to fabricate the piezoelectric actuator of the present invention (FIG. 6A).

The piezoelectric actuators thus structured were mounted on an electronic device (handset) by an adhesive material as shown in FIG. 12. A structure of the handset is conventional, that is, a display and input keys are provided on one side of a case 3 and an antenna is provided at an edge surface to the liquid crystal display side. The piezoelectric actuators were mounted between the display and electronic circuit boards and on an internal surface of the case 3 of FIG. 12.

An ABS resin of 1 mm thick was used for the case 3 and grooves 10 of 0.5 mm in width and 0.5 mm in depth were formed on the case surface as shown in FIG. 6B such that the grooves divide the surface into several portions corresponding to positions where the piezoelectric ceramic oscillators were mounted.

To verify an effect of the present invention, one of the two piezoelectric ceramic oscillators which can be activated separately (a piezoelectric ceramic oscillator inside of an observation point A in FIG. 6B) was activated by alternating electric field of 200 Hz and effective voltage of 10 V. Then vibrations of the surface of the case 3 were measured by a laser vibration speed meter. Observation points were four points (A, B, C and D in FIG. 6B) separated by the grooves 10 formed on the external surface of the case 3.

To verify an effect of the groove 10 formed on the case 3, a device that has no groove 10 on a case 3 was fabricated using the same process. Also a piezoelectric ceramic oscillator having no narrow part 9 of a shim member 6 was fabricated by the same process to verify an effect of the narrow part 9 formed on a shim member 6.

Table 1 shows a result of measured vibration speeds at four points when three kinds of actuators were used, in which the speed is normalized by the standard vibration speed at the observation point A when the grooves 10 and the narrow part 9 were formed (relative values are also shown in tables hereinafter).

TABLE 1

| | Observation point | A | B | C | D |
|---|---|---|---|---|---|
| 1-1 | Case grooves + narrow part of shim member | 1.0 | 0.3 | 0.2 | 0.1 |
| 1-2 | No case groove + narrow part of shim member | 0.3 | 0.2 | 0.2 | 0.2 |
| 1-3 | Case grooves + no narrow part of shim member | 0.3 | 0.3 | 0.2 | 0.2 |

As we can see from Table 1, an amount of vibration at point A decreased by 70% when the grooves 10 of the case 3 or the narrow part 9 of the shim member 6 is not formed. And when the grooves 10 are not formed on the case 3, observed vibration speeds at three points other than the point where the oscillator was activated had no difference. This means that separation of vibration positions becomes difficult. When the narrow part 9 of the shim member 6 was not formed, vibration speeds at points A and B were almost the same as well as at points C and D.

The result above revealed the effects of the present invention of separation of vibration positions and differences of vibration speeds. When the grooves 10 are not formed, the vibration is transmitted to the whole case 3 and the amount of vibration at point A is reduced. And when the narrow part 9 is not formed, vibrations of the piezoelectric ceramic oscillators are not isolated and the center portion preferentially vibrates, and then the amount of vibration at point A is reduced.

Although it is not shown in Table 1, when two piezoelectric ceramic oscillators provided on the reverse side of points A and B were activated at the same time and the same phase, twice the amount of vibration was observed at both points A and B compared with the amount of vibration when one piezoelectric ceramic oscillator provided on the reverse side of point A was activated.

Example 2

Figure 7A:
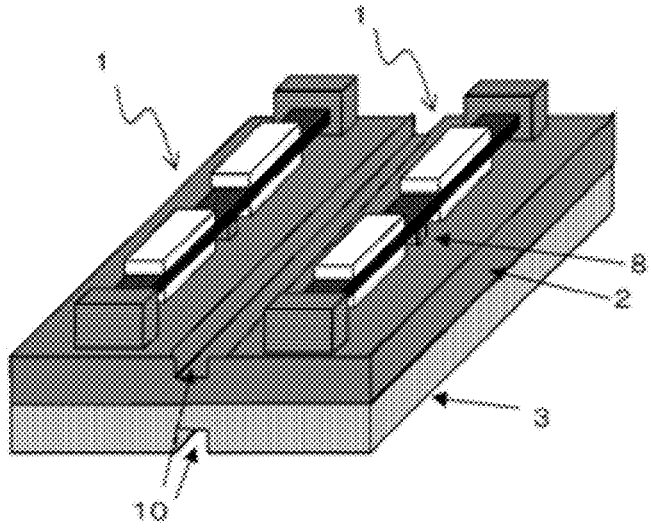
FIG. 7A is a perspective view of a piezoelectric actuator according to Example 2 of the present invention and FIG. 7B shows an observation point of Example 2.
Figure 7B:
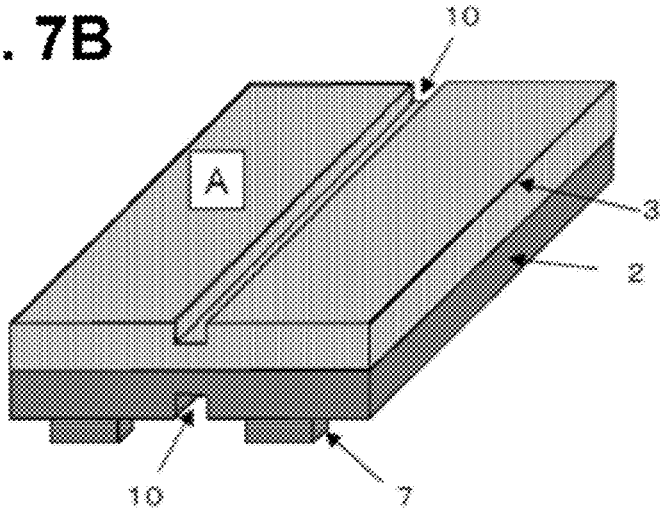

As shown FIG. 7A, a piezoelectric actuator 1, in which a position of an auxiliary holder 8 provided on a piezoelectric ceramic oscillator was different from that of Example 1, was fabricated as an example 2. A piezoelectric actuator having no auxiliary holder 8 was also fabricated as a comparison and vibration speeds at an observation point A were measured as shown in FIG. 7B. Shapes of the piezoelectric ceramic thin plate 5, shim member 6 and holder 7 were the same as those of Example 1 and a size of the auxiliary holder 8 was 4 mm in length, 4 mm in width and 1.9 mm in height.

One of the four piezoelectric ceramic oscillators was chosen to be applied with electric field. The observation point A was located on the external surface of the case 3 where the auxiliary holder 8 of the piezoelectric actuator 1, which had the activated piezoelectric ceramic oscillator, was attached. Table 2 shows results when the auxiliary holder 8 was attached and was not attached.

TABLE 2

| | Observation point | A |
|---|---|---|
| 2-1 | Auxiliary holder attached | 1.0 |
| 2-2 | No auxiliary holder attached | 0.3 |

As shown by Table 2, the amount of vibration at the point A increased by three times or more by attaching the auxiliary holder 8 at the center portion compared with that when the auxiliary holder 8 was not attached. The effect of the auxiliary holder 8 of the present invention was verified.

Example 3

Figure 8:
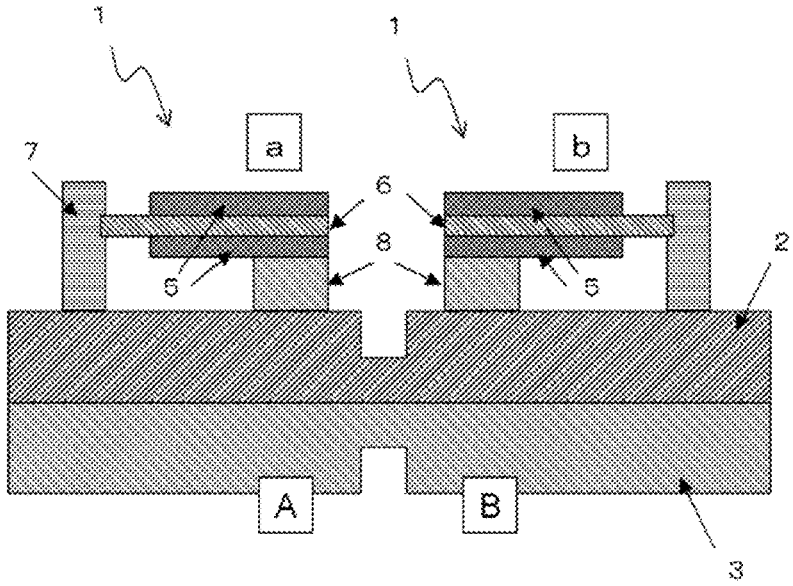
FIG. 8 is a sectional view of a piezoelectric actuator according to Example 3 of the present invention.

As shown in FIG. 8, two piezoelectric actuators 1 each having one piezoelectric ceramic oscillator were prepared and provided on the case 3 as an example 3. Shapes of the piezoelectric ceramic thin plate 5, holder 7 and auxiliary holder 8 were the same as those of Example 1. A shape of the shim member 6 was 12 mm in length, 4 mm in width and 0.2 mm in thickness. Grooves 10 were formed on the sheet-shaped elastic body 2 and the case 3.

The fabricated actuators 1 were mounted on the case 3 as shown in FIG. 8 and vibration speeds at points A and B were measured when the piezoelectric ceramic oscillator (a) at the reverse side of the point A was activated and when both of the piezoelectric ceramic oscillators (a) and (b) were activated. The results are shown in Table 3.

TABLE 3

| | Observation point | A | B |
|---|---|---|---|
| 3-1 | (a) was activated | 1.0 | 0.2 |
| 3-2 | (a) and (b) were activated | 1.2 | 1.2 |

As clearly shown in Table 3, transmission of vibration to the next piezoelectric ceramic oscillator was reduced up to 20%. When the two oscillators were activated at the same time, the amount of vibration at each point increased by 20% compared with that when activated individually. The effects of the groove 10 on the case 3 and reduction of the size of the piezoelectric actuator by providing only one piezoelectric ceramic oscillator were obtained.

Example 4

Figure 9:
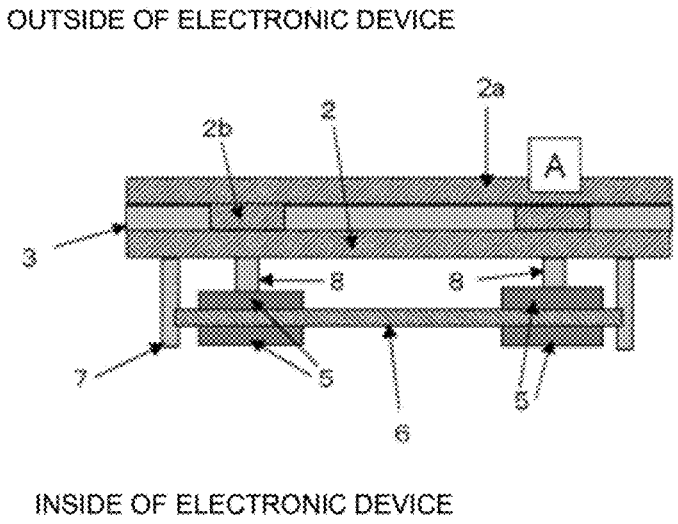
FIG. 9 is a sectional view of a piezoelectric actuator according to the Example 4 of the present invention.

As shown in FIG. 9, an actuator mounted on a case, in which penetration holes were provided on the case at positions on which piezoelectric ceramic thin plates 5 of a piezoelectric ceramic oscillator were arranged and an elastic body 2*b* is filled in the holes and external surface of the case was covered by an elastic body 2*a*, was fabricated as an example 4. Vibration speed at point A and a falling shock-resistance were compared with the mobile terminal case mounting the piezoelectric actuator of Example 1. The piezoelectric ceramic oscillator mounted at the reverse side of the point A was activated (FIG. 9).

The penetration hole of the case 3 had a length of 2 mm, width of 2 mm and depth of 1 mm (thickness of the case). The elastic body 2*a* to cover the case 3 was made of a silicone rubber of 0.5 mm in thickness.

Table 4 shows a result compared with the result of Example 1.

TABLE 4

| | Example 1 | Example 4 |
|---|---|---|
| Vibration speed at point A | 1.0 | 2.0 |
| Falling shock-resistance | Very good | good |

According to Table 4, the vibration speed of Example 4 at the point A was about two times larger th Example 1. The falling shock-resistance of an example 4 could keep practically acceptable level although it was inferior to Example 1. An effect of the example was apparent.

Example 5

Figure 10A:
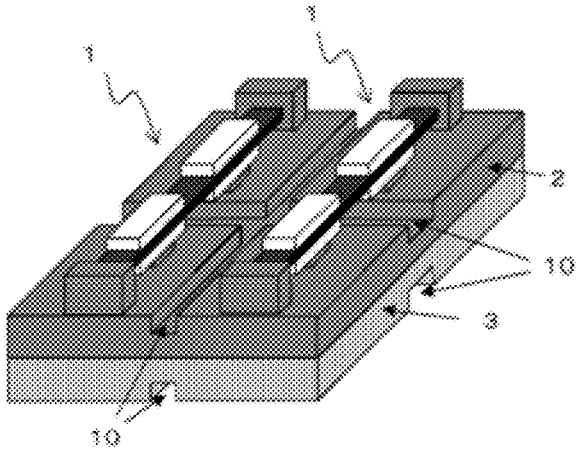
FIG. 10A is a perspective view of a piezoelectric actuator according to Example 5 of the present invention and FIG. 10B shows observation points of Example 5.
Figure 10B:
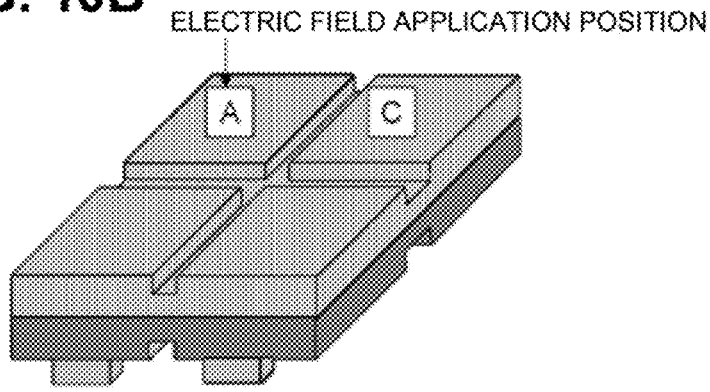

The sheet-shaped elastic body 2 of Example 1 was replaced by a silicone rubber having grooves 10, each of which has a width of 2 mm and depth of 0.3 mm, crossing at the center of the sheet as Example 5. A shim member 6 having no narrow part was used for a piezoelectric ceramic oscillator and a piezoelectric ceramic thin plate 5, holder 7, auxiliary holder 8 and case 3 were the same as Example 1. A vibration speed at a position C on the case 3 when the piezoelectric ceramic oscillator provided at the reverse side of a position A in FIG. 10B was measured as Example 1, and an effect of the grooves of the sheet-shaped elastic body was evaluated (Table 5). Owing to the grooves of the sheet-shaped elastic body, the amount of vibration transmission from point A to point C was reduced by 20%.

TABLE 5

| | Observation point | C |
|---|---|---|
| 5-1 | Case grooves + no groove of sheet-shaped elastic body (Example 1) | 1.0 |
| 5-2 | Case grooves + grooves of sheet-shaped elastic body (Example 5) | 0.8 |

Example 6

A piezoelectric actuator, which a shim member (metal hinge 11) having a thickness of 0.2 mm was bonded to a piezoelectric ceramic thin plate 5 of 10 mm in length, 4 mm in width and 0.2 mm in thickness and they were attached to a case 3 via a sheet-shaped elastic body 2 (silicone rubber) of 2 mm in length and width and 0.2 mm in thickness provided at the center of the metal hinge, was prepared as shown in FIG. 11A as an example 6. A gap between the piezoelectric ceramic thin plate 5 and the metal hinge 11 at the center of the shim member was 0.2 mm. An epoxy resin was used for adhesion between the sheet-shaped elastic body 2 and both of the case 3 and the metal hinge 11. In addition, an actuator of which the metal hinge 11 has a vibration magnification structure 12 of a U-shaped bending was also prepared as shown in FIG. 11B. Vibration amounts were measured when the piezoelectric actuators were activated by a condition of 10V of effective voltage and 200 Hz (Table 6). The amount of vibration was largely reduced because a number of the piezoelectric ceramic thin plate 5 was only one. However, an amount of reduction of vibration of the actuator having the vibration magnification structure 12 was limited to 20% and it means that an effect for reduction of a size and thickness of the actuator was verified.

TABLE 6

| | Point A of Example 1-1 | FIG. 11A | FIG. 11B |
|---|---|---|---|
| Vibration (relative value) | 1.0 | 0.4 | 0.8 |

It should be noted that other objects, features and aspects of the present invention will become apparent in the entire disclosure and that modifications may be done without departing the gist and scope of the present invention as disclosed herein and claimed as appended herewith. Also it should be noted that any combination of the disclosed and/or claimed elements, matters and/or items may fall under the modification aforementioned.

The invention claimed is:

1. A piezoelectric actuator comprising a shim member, at least one piezoelectric ceramic oscillator formed of a piezoelectric ceramic thin plate bonded to at least one surface of the shim member and at least one holder which holds the shim member, wherein:

the piezoelectric actuator comprises a sheet-shaped elastic body which has a case-side surface connected to a case and an oscillator-side surface connected to the at least one holder, and wherein the sheet-shaped elastic body has a groove on the oscillator-side surface.

2. The piezoelectric actuator according to claim 1, further comprising at least one auxiliary holder connected between the at least one piezoelectric ceramic oscillator and the sheet-shaped elastic body at a position apart from the at least one holder.

3. The piezoelectric actuator according to claim 1, further comprising at least one auxiliary holder connected between the shim member and the sheet-shaped elastic body at a position apart from the at least one holder.

4. The piezoelectric actuator according to claim 1, wherein a narrow part is formed in the shim member between adjoining piezoelectric ceramic oscillators bonded on the shim member.

5. The piezoelectric actuator according to claim 2, wherein a plurality of the piezoelectric ceramic oscillators are connected to the sheet-shaped elastic body via the at least one holder and the at least one auxiliary holder, and wherein the groove is formed on the sheet-shaped elastic body between adjoining piezoelectric ceramic oscillators.

6. The piezoelectric actuator according to claim 1, wherein the piezoelectric actuator is connected to one side surface of a case of an electronic device via the sheet-shaped elastic body, wherein the shim member is formed as a metal hinge having at least one bending portion, and wherein the at least one piezoelectric ceramic oscillator and the case are connected via the metal hinge and the sheet-shaped elastic body that acts as the at least one holder.

7. The piezoelectric actuator according to claim 1, wherein the at least one piezoelectric ceramic oscillator is activated by a pulse shaped or sinusoidal alternating electric field having a frequency of 100 Hz to 1 kHz.

8. An electronic device comprising a plurality of the piezoelectric actuators according to claim 1, the plurality of the piezoelectric actuators being used as oscillation sources, and wherein the electronic device has a function to convey various kinds of information to a user by making a case of the electronic device vibrate in multiple stereoscopic patterns.

9. An electronic device comprising a plurality of the piezoelectric actuators according to claim 1, the plurality of the piezoelectric actuators being used as oscillation sources, and wherein a case of the electronic device can be stereoscopically vibrated.

10. The electronic device according to claim 9, wherein the case of the electronic device has a groove or a part of different thickness.

11. An electronic device comprising the piezoelectric actuator according to claim 1, wherein the electronic device has a function to convert vibration generated on a case into voltage by the piezoelectric actuator.

12. A piezoelectric actuator comprising a shim member, at least one piezoelectric ceramic oscillator formed of a piezoelectric ceramic thin plate bonded to at least one surface of the shim member and at least one holder which holds the shim member, wherein:

the piezoelectric actuator comprises a sheet-shaped elastic body which is connected to the at least one holder, the sheet-shaped elastic body has a groove, the piezoelectric actuator is connected to one side surface of a case of an electronic device via the sheet-shaped elastic body, and wherein the case has a groove, formed on another side surface of the case.

13. A piezoelectric actuator comprising a shim member, at least one piezoelectric ceramic oscillator formed of a piezoelectric ceramic thin plate bonded to at least one surface of the shim member and at least one holder which holds the shim member, wherein:

the piezoelectric actuator comprises a sheet-shaped elastic body which is connected to the at least one holder, the sheet-shaped elastic body has a groove, the piezoelectric actuator is connected to one side surface of a case of an electronic device via the sheet-shaped elastic body, and wherein a penetration hole is perforated at a part of the case where the piezoelectric actuator is connected, and the penetration hole is filled with an elastic body.

* * * * *